US011713760B2

(12) United States Patent
Zhao et al.

(10) Patent No.: US 11,713,760 B2
(45) Date of Patent: Aug. 1, 2023

(54) INTAKE PIPE USED FOR COMPRESSOR SYSTEM AND COMPRESSOR SYSTEM

(71) Applicant: Emerson Climate Technologies (Suzhou) Co., Ltd., Jiangsu (CN)

(72) Inventors: Ping Zhao, Suzhou (CN); Junshan Pan, Suzhou (CN); Ji Liang, Suzhou (CN)

(73) Assignee: Emerson Climate Technologies (Suzhou) Co., Ltd., Jiangsu (CN)

( * ) Notice: Subject to any disclaimer, the term of this patent is extended or adjusted under 35 U.S.C. 154(b) by 90 days.

(21) Appl. No.: 16/957,701

(22) PCT Filed: Dec. 27, 2018

(86) PCT No.: PCT/CN2018/124109
§ 371 (c)(1),
(2) Date: Jun. 24, 2020

(87) PCT Pub. No.: WO2019/129113
PCT Pub. Date: Jul. 4, 2019

(65) Prior Publication Data

US 2020/0362862 A1 Nov. 19, 2020

(30) Foreign Application Priority Data

Dec. 28, 2017 (CN) ..... 201711462680.9
Dec. 28, 2017 (CN) ..... 201721877165.2

(51) Int. Cl.
*F04C 29/00* (2006.01)
*F04C 29/02* (2006.01)
(Continued)

(52) U.S. Cl.
CPC ..... *F04C 29/0007* (2013.01); *F04C 23/001* (2013.01); *F04C 29/021* (2013.01);
(Continued)

(58) Field of Classification Search
CPC .. F04C 29/0007; F04C 23/001; F04C 29/021; F04C 29/026; F04C 11/001;
(Continued)

(56) References Cited

U.S. PATENT DOCUMENTS 2,316,016 A * 4/1943 Packie ..... B01D 45/08 55/458
2,749,723 A * 6/1956 Webber ..... F22B 37/265 62/472
(Continued)

FOREIGN PATENT DOCUMENTS

CN 1776227 A 5/2006
CN 104074726 A 10/2014
(Continued)

OTHER PUBLICATIONS

Search Report (in English and Chinese) and Written Opinion of the International Searching Authority (in Chinese) issued in PCT/CN2018/124109, dated Mar. 13, 2019; ISA/CN.

*Primary Examiner* — Dominick L Plakkoottam
*Assistant Examiner* — Paul W Thiede
(74) *Attorney, Agent, or Firm* — Harness, Dickey & Pierce, P.L.C.

(57) ABSTRACT

A compressor system (10) and an intake pipe (300) used for the compressor system (10), wherein the intake pipe (300) comprises: a lubricant separator (310), which is configured to separate a lubricant which is in a compression fluid flowing through the intake pipe (300); and a first lubricant supply pipe (340), which is configured to supply the separated lubricant to a first compressor (100) or a second compressor (200) in the compressor system (10).

20 Claims, 8 Drawing Sheets

(51) Int. Cl.

| | |
|---|---|
| ***F04C 23/00*** | (2006.01) |
| ***F04C 11/00*** | (2006.01) |
| ***F04C 18/02*** | (2006.01) |
| ***F04C 29/12*** | (2006.01) |

(52) U.S. Cl.
CPC ..... *F04C 29/026* (2013.01); *F04C 11/001* (2013.01); *F04C 18/0215* (2013.01); *F04C 23/008* (2013.01); *F04C 29/12* (2013.01); *F04C 2240/81* (2013.01)

(58) Field of Classification Search
CPC .... F04C 18/0215; F04C 23/008; F04C 29/12; F04C 2240/81; F25B 31/004; F25B 31/002
See application file for complete search history.

(56) References Cited

U.S. PATENT DOCUMENTS

| | | | | | |
|---|---|---|---|---|---|
| 3,633,377 | A * | 1/1972 | Quick | F25B 43/02 | 62/468 |
| 5,094,598 | A * | 3/1992 | Amata | F16N 19/006 | 62/468 |
| 5,327,997 | A * | 7/1994 | Nash, Jr | G01F 23/60 | 62/468 |
| 5,502,984 | A * | 4/1996 | Boehde | B01D 45/12 | 210/512.1 |
| 6,574,986 | B2 * | 6/2003 | Morimoto | B01D 45/12 | 62/470 |
| 7,246,507 | B2 * | 7/2007 | Yamada | F25B 31/002 | 62/473 |
| 9,410,547 | B2 * | 8/2016 | Toyama | F04C 29/028 | |
| 10,330,093 | B2 | 6/2019 | Fan et al. | | |
| 11,112,157 | B2 | 9/2021 | Crolius et al. | | |
| 11,125,480 | B2 | 9/2021 | Sullivan et al. | | |
| 2002/0023459 | A1 * | 2/2002 | Kiyokawa | F25B 31/002 | 62/469 |
| 2006/0101845 | A1 | 5/2006 | Jeong et al. | | |
| 2006/0196221 | A1 * | 9/2006 | Westermeyer | F25B 43/02 | 62/84 |
| 2010/0186433 | A1 * | 7/2010 | Galante | F04C 23/008 | 62/115 |
| 2011/0174005 | A1 * | 7/2011 | Takegami | F25B 1/10 | 62/228.1 |
| 2011/0239667 | A1 * | 10/2011 | Won | F25B 31/004 | 62/84 |
| 2013/0177404 | A1 | 7/2013 | Bernardi et al. | | |
| 2014/0044581 | A1 * | 2/2014 | Mao | F04C 23/008 | 418/55.1 |
| 2014/0056725 | A1 | 2/2014 | Fraser et al. | | |
| 2014/0241926 | A1 * | 8/2014 | Fraser | F04C 23/008 | 418/55.1 |
| 2016/0187173 | A1 * | 6/2016 | Jang | F04B 51/00 | 73/304 C |
| 2016/0231035 | A1 * | 8/2016 | Lee | F25B 31/004 | |
| 2017/0284706 | A1 * | 10/2017 | Ozu | F25B 5/00 | |

FOREIGN PATENT DOCUMENTS

| | | | | |
|---|---|---|---|---|
| CN | 104641116 | A | 5/2015 | |
| CN | 207920875 | U | 9/2018 | |
| EP | 1731856 | A2 * | 12/2006 | F25B 43/02 |
| EP | 2196747 | A1 * | 6/2010 | F25B 31/004 |
| JP | H04214988 | A | 8/1992 | |

* cited by examiner

INTAKE PIPE USED FOR COMPRESSOR SYSTEM AND COMPRESSOR SYSTEM

CROSS-REFERENCE TO RELATED APPLICATIONS

This application is the national phase of International Application No. PCT/CN2018/124109 tilted "AIR INTAKE PIPE USED FOR COMPRESSOR SYSTEM AND COMPRESSOR SYSTEM" and filed on Dec. 27, 2018, which claims the priority to Chinese Patent Application No. 201711462680.9, titled "INTAKE PIPE USED FOR COMPRESSOR SYSTEM AND COMPRESSOR SYSTEM", filed with the China National Intellectual Property Administration on Dec. 28, 2017, and Chinese Patent Application No. 201721877165.2, titled "INTAKE PIPE USED FOR COMPRESSOR SYSTEM AND COMPRESSOR SYSTEM", filed with the China National Intellectual Property Administration on Dec. 28, 2017. These applications are incorporated herein by reference in their entirety.

FIELD

This disclosure relates to the field of compressor system and, in particular, to an intake pipe used for a compressor system.

BACKGROUND

The contents of this section only provide background information related to the present disclosure and may not necessarily constitute the prior art.

It is known a compressor system which is formed of two or more compressors connected in parallel. The compressor system can reduce the cost of the system and improve the operating efficiency of the system by replacing a single compressor with a large cooling capacity with multiple compressors with relatively small cooling capacity. In such a compressor system formed of multiple compressors connected in parallel, an important problem is how to ensure the lubricant balance between the multiple compressors. Although various methods have been proposed to solve the problem of lubricant imbalance in such compressor systems, there is still much room for improvement, especially when the compressor system includes a variable capacity compressor or a variable frequency compressor.

SUMMARY

However, there is no effective technical means that can solve the problem of lubricant imbalance between the compressors of the compressor system presently.

An object of one or more embodiments of this disclosure is to provide an intake pipe for a compressor system capable of solving the problem of lubricant imbalance between compressors in the compressor system.

Another object of one or more embodiments of this disclosure is to provide a compressor system including the above intake pipe.

According to one aspect of this disclosure, an intake pipe for a compressor system is provided, which includes:

- a lubricant separator, which is configured to separate lubricant from the fluid to be compressed and flowing through the intake pipe; and
- a first lubricant supply pipe, which is configured to supply the separated lubricant to a first compressor or a second compressor in the compressor system.

Preferably, a first intake branch pipe and a second intake branch pipe of the intake pipe are configured to guide the fluid to be compressed and flowing into the lubricant separator to the first compressor and the second compressor in the compressor system, respectively.

Preferably, a portion of the first intake branch pipe and a portion of the second intake branch pipe both extend into the interior of the lubricant separator.

Preferably, the lubricant separator includes a top opening, a side wall and a bottom wall, wherein the top opening allows fluid to be compressed to enter the lubricant separator, the side wall is provided with a first side wall outlet and a second side wall outlet, the first intake branch pipe extends through the first side wall outlet, the second intake branch pipe extends through the second side wall outlet, and the bottom wall is provided with a bottom wall opening to communicate with one end of the first lubricant supply pipe.

Preferably, the other end of the first lubricant supply pipe can selectively communicate with the first intake branch pipe or the second intake branch pipe.

Preferably, the other end of the first lubricant supply pipe can selectively communicate with a first housing of the first compressor or a second housing of the second compressor.

Preferably, a partition plate is provided between the first and second side wall outlets and the bottom wall, and the partition plate is provided with an orifice allowing lubricant to flow therethrough.

Preferably, the side wall is provided to have, between the first and second side wall outlets and the top opening, an upper truncated conical structure tapering toward the top opening; and/or have, between the first and second side wall outlets and the bottom wall, a lower truncated conical structure tapering toward the bottom wall.

Preferably, the intake pipe further includes a valve provided on the first lubricant supply pipe to selectively supply the lubricant to the first compressor or the second compressor.

Preferably, the intake pipe further includes a second lubricant supply pipe. In a case that the first lubricant supply pipe is configured to supply the separated lubricant to the first compressor, the second lubricant supply pipe is configured to supply the separated lubricant to the second compressor,

- wherein the intake pipe further includes a valve to selectively supply the lubricant to the first compressor through the first lubricant supply pipe or to the second compressor through the second lubricant supply pipe.

According to another aspect of this disclosure, a compressor system is provided, which includes:

- a first compressor, which includes a first housing, and a first inlet and a first outlet provided in the first housing;
- a second compressor, which includes a second housing, and a second inlet and a second outlet provided on the second housing; and
- the intake pipe for the compressor system described herein,
- wherein the first inlet and the second inlet can communicate with each other through the intake pipe and can be supplied with fluid to be compressed.

Preferably, sensors are provided in the first compressor and/or the second compressor for obtaining sensing information as to whether the lubricant is insufficient in the first compressor or the second compressor.

Preferably, the sensor includes at least one of a pressure sensor, a liquid level sensor, a rotational speed sensor, a vibration sensor, a torque sensor, a temperature sensor, and a flow sensor.

Preferably, the compressor system further includes a control component. The control component is configured to determine whether the lubricant is insufficient in the first compressor or the second compressor based on the sensing information of the sensor, so as to supply lubricant to one of the first compressor and the second compressor in which the lubricant is insufficient by controlling the operation of the valve of the intake pipe.

Preferably, the compressor system further includes a control component. The control component is configured to determine whether the lubricant is insufficient in the first compressor or the second compressor based on a rotational speed of a drive shaft of the first compressor and/or the second compressor, so as to supply lubricant to one of the first compressor and the second compressor in which the lubricant is insufficient by controlling the operation of the valve of the intake pipe.

Preferably, the first compressor and/or the second compressor include a variable capacity compressor or a variable frequency compressor.

The intake pipe for a compressor system and the compressor system according to one or more embodiments of this disclosure have at least one of the following advantages: the lubricant can be separated from the fluid to be compressed before it enters the compressors, and the separated lubricant can be supplied to the compressor with insufficient lubricant, thereby alleviating or even eliminating the lubricant imbalance problem between the compressors in the compressor system; preferably, the separated lubricant can be directly supplied into the compressor housing to reduce the lubricant content in the fluid to be compressed which enters the compressor, thereby preventing the compression mechanism in the compressor from being damaged due to excessive lubricant suction.

Other fields of application will become apparent through the description provided herein. It should be understood that the specific examples and embodiments described in this section are for illustration only and are not intended to limit the scope of the present application.

BRIEF DESCRIPTION OF THE DRAWINGS

The drawings depicted herein are for illustrative purpose only and are not intended to limit the scope of this disclosure in any way. The drawings are not drawn to scale, and some features may be enlarged or minified to show the details of a particular member. In the drawings.

It will be noted that, throughout all the drawings, the corresponding reference numerals indicate the like or corresponding parts or features. For the sake of clarity, not all parts in the drawings are labeled.

DETAILED DESCRIPTION OF THE EMBODIMENTS

The following description of various embodiments of this disclosure is only illustrative and is by no means intended to limit this disclosure and the application or usage thereof.

Firstly, a compressor system 1 in the related art is briefly described with reference to FIG. 1.

Figure 1:
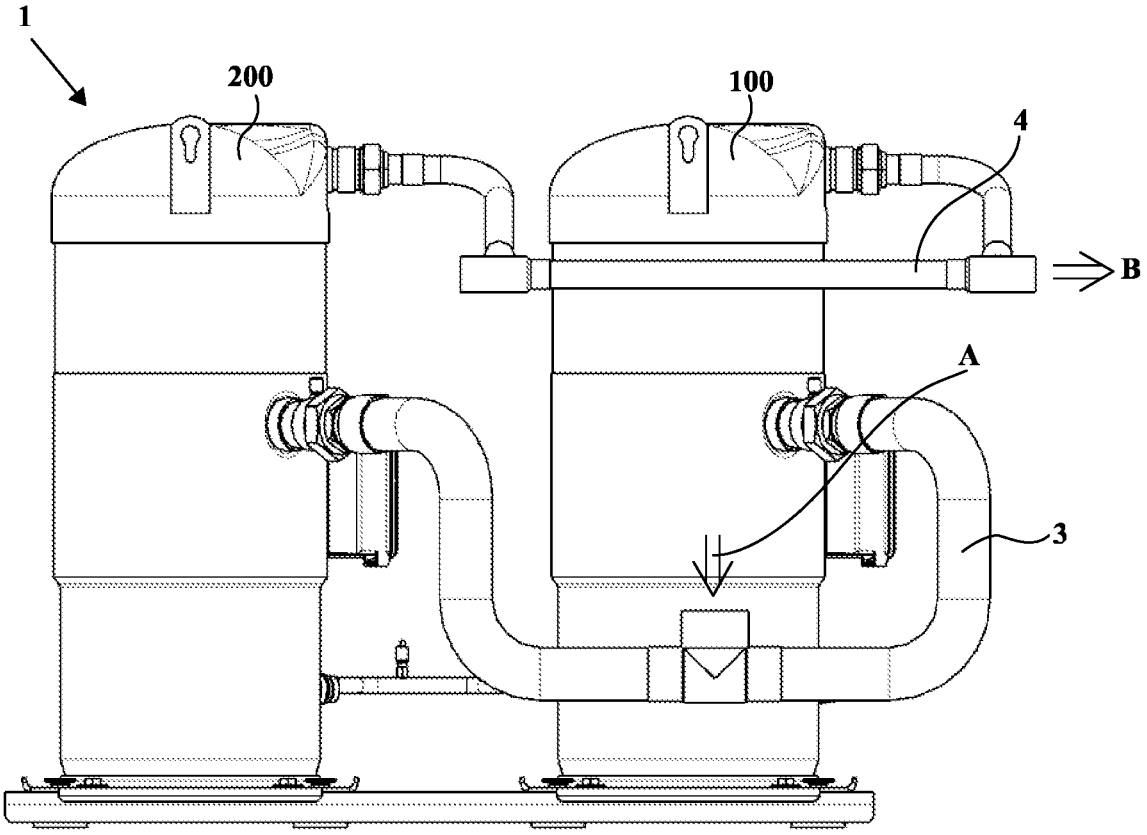
Figure 1 Prior Art
FIG. 1 is a schematic side view of a compressor system in the related art.

As shown in FIG. 1, the compressor system 1 includes a first compressor 100, a second compressor 200, an intake pipe 3, and a discharge pipe 4. Fluid (shown by arrow A) is to be compressed and supplied from an application equipment (not shown) such as a refrigeration device via the intake pipe 3 to the first compressor 100 and the second compressor 200, and compressed by the first compressor 100 and the second compressor 200 and is then returned to the application equipment (shown by arrow B) through the discharge pipe 4. However, in some cases, such a compressor system composed of two or more compressors has difficulty in ensuring the lubricant balance between the compressors. For example, due to the difference in intake pressure between the compressors, the difference in intake volume, the asymmetry in pipeline design or manufacture, and other factors, one or more compressors may suffer from insufficient lubricant under certain operating conditions.

For this reason, an intake pipe and a compressor system including the intake pipe which are capable of alleviating or even solving the problem of lubricant imbalance between the compressors of a compressor system are provided according to the present application.

Figure 2A:
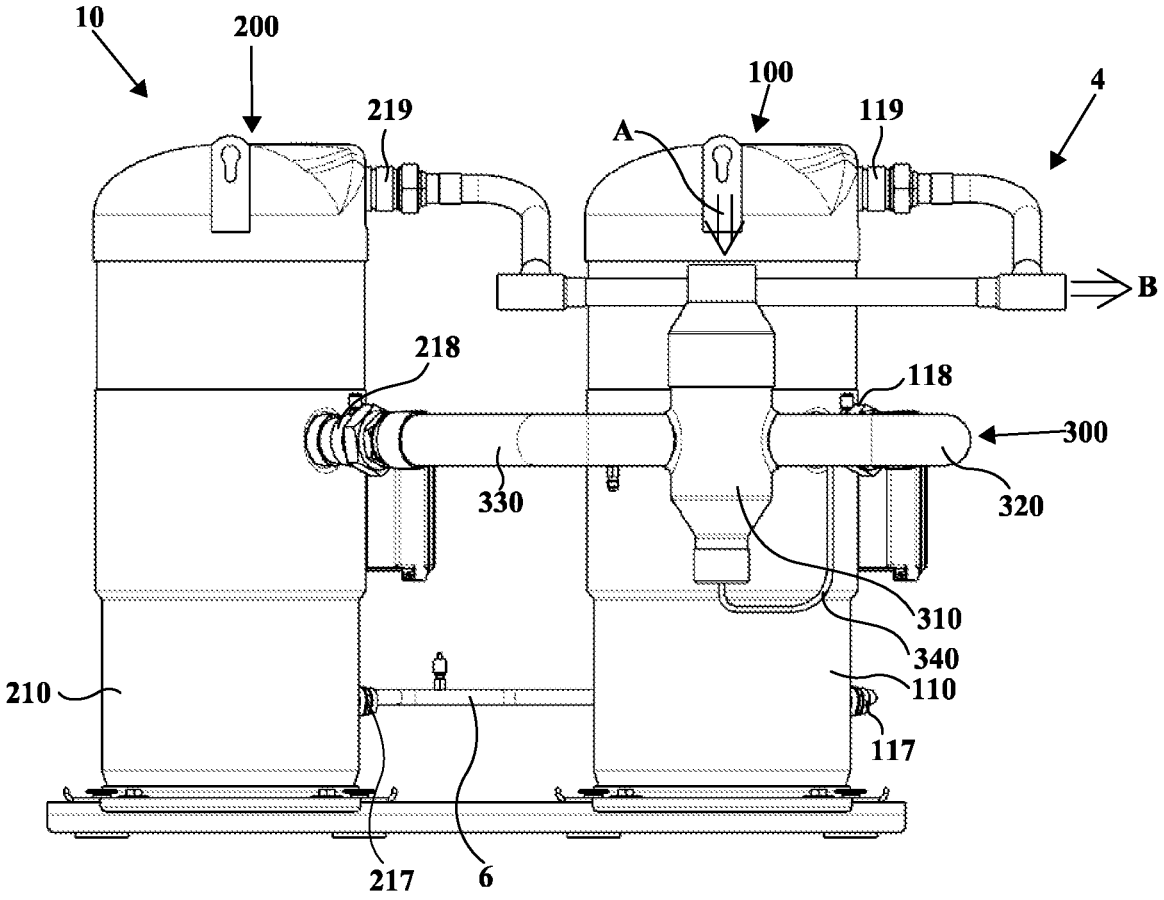
FIG. 2A is a schematic side view of a compressor system according to an embodiment of this disclosure.

In particular, the basic configuration and principle of a compressor system 10 according to an embodiment of the present application are described in detail with reference to FIGS. 2 to 4.

As shown in FIG. 2, similarly, the compressor system 10 mainly includes a first compressor 100, a second compressor 200, an intake pipe 300 and a discharge pipe 4. The first compressor 100 and the second compressor 200 are connected in parallel to each other to constitute a so-called multiple on-line system. It should be understood by those skilled in the art that the compressor system 10 according to this disclosure may include more compressors connected in parallel.

Specifically, the first compressor 100 may include a first housing 110, and a first inlet 118 and a first outlet 119 provided in the first housing 110. The first housing 110 may include a first intake pressure region and a first discharge pressure region (described in detail later with reference to FIG. 4). Besides, lubricant is stored in the first housing 110. In the configuration of such a vertical compressor, lubricant is generally stored in a bottom region of the first housing 110. Similarly, the second compressor 200 may include a second housing 210, and a second inlet 218 and a second outlet 219 provided in the second housing 210. The second housing 210 may include a second intake pressure region and a second discharge pressure region (described in detail later with reference to FIG. 3). Besides, lubricant is stored in the second housing 210.

The first inlet 118 and the second inlet 218 are in fluid communication (hereinafter, referred to as communication for short) with each other through the intake pipe 300 and are supplied with fluid to be compressed (hereinafter, referred to as fluid for short) through the intake pipe 300, as indicated by arrow A. The first outlet 119 and the second outlet 219 communicate with each other through the discharge pipe 4 and discharge fluid through the discharge pipe 4 (as indicated by arrow B).

More specifically, the intake pipe 300 may include a first intake branch pipe 320 connected (that is, fluid communication herein) to the first inlet 118, a second intake branch pipe 330 connected to the second inlet 218, and a lubricant separator 310 connecting the first intake branch pipe 320 and the second intake branch pipe 330 together.

Figure 5:
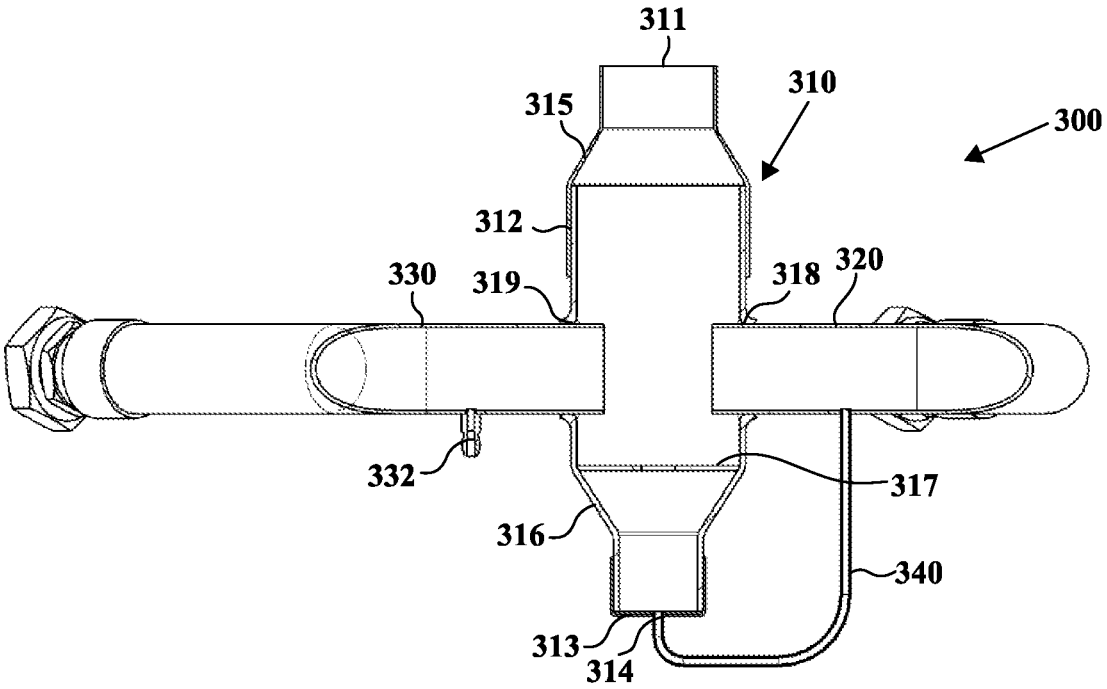
FIG. 5 is a schematic partial sectional view of an intake pipe of the compressor system shown in FIG. 2.

Intake gas (sucked fluid to be compressed) in the compressor system 10 may be sucked in through a top opening 311 (as shown in FIG. 5) of the lubricant separator 310, and then be sucked into the first compressor 100 and the second compressor 200 through the first intake branch pipe 320 and the second intake branch pipe 330, respectively.

A lubricant balance pipe 6 is provided between the first compressor 100 and the second compressor 200 so that lubricant in one compressor can flow into the other compressor through the lubricant balance pipe 6. For example, the lubricant balance pipe 6 may be connected to both a lubricant balance port 117 provided in the first compressor 100 and a lubricant balance port 217 provided in the second compressor 200.

The specific configuration of the compressor system 10 is described in detail below with reference to FIGS. 3 and 4 by taking a variable capacity scroll compressor and a constant capacity scroll compressor as examples. However, those skilled in the art will understand that the compressor system 10 may include two or more constant capacity scroll compressors, or may include two or more variable capacity scroll compressors, or may include one variable capacity scroll compressor and one or more constant capacity scrolls compressors.

Figure 2B:
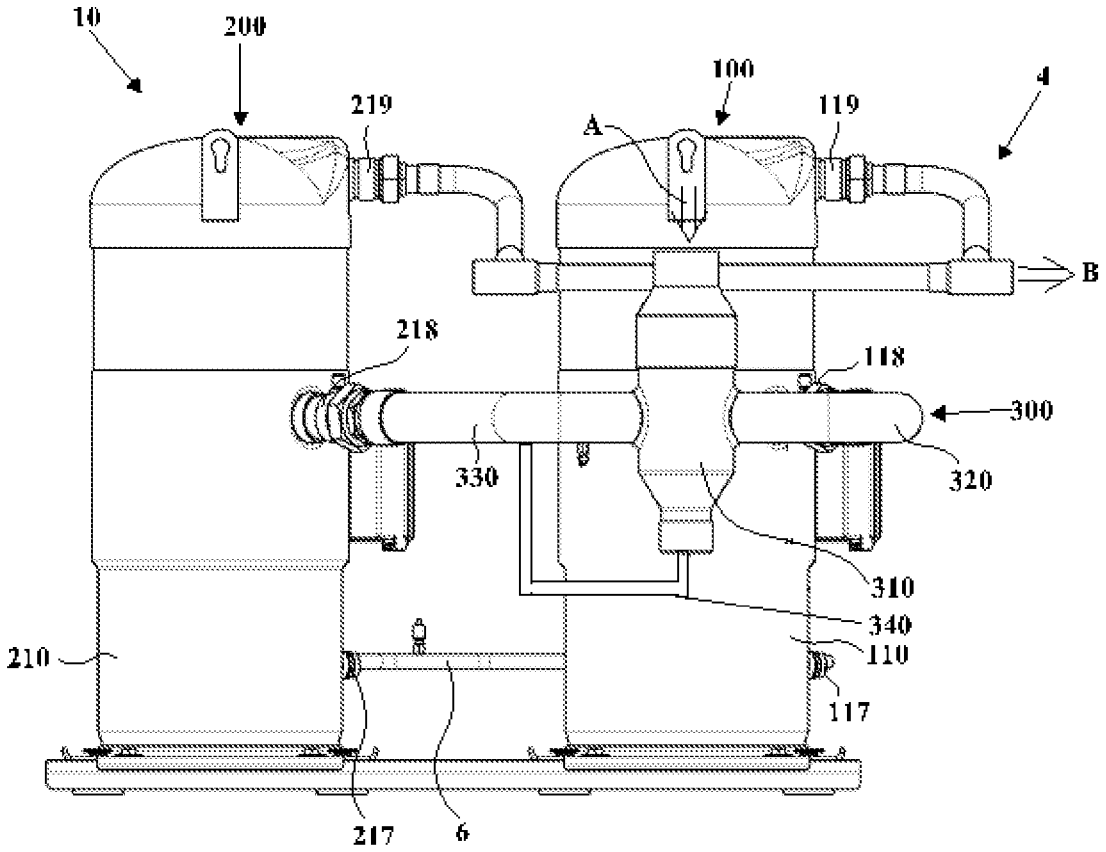
FIG. 2B is a schematic side view of a compressor system according to another embodiment of this disclosure.
Figure 3:
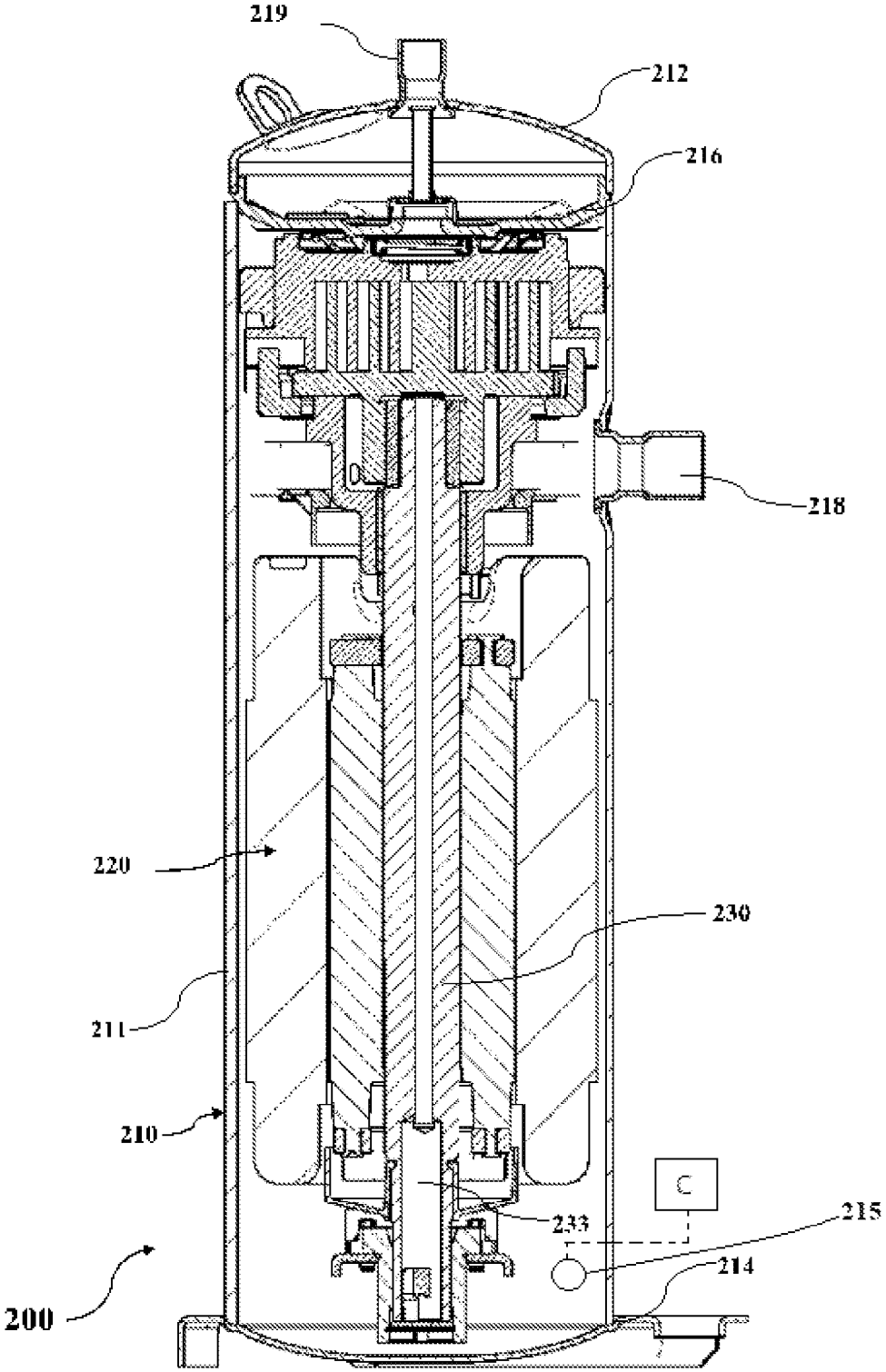
FIG. 3 is a schematic sectional view of a compressor in the compressor system according to an embodiment of this disclosure.

FIG. 3 shows an example of a constant capacity scroll compressor. The second compressor 200 in FIG. 2 may adopt the compressor constructed and shown in FIG. 3, but it is not limited thereto. The configuration of the compressor 200 will be described in detail below by way of an example of a constant capacity scroll compressor. The housing 210 (the second housing 210 described above) of the second compressor 200 (scroll compressor) shown in FIG. 3 includes a substantially cylindrical body 211, a top cover 212 arranged at one end of the body 211, and a bottom cover 214 arranged at the other end of the body 211. A partition plate 216 is arranged between the top cover 212 and the body 211 to partition an internal space of the compressor into a high-pressure side (that is, discharge pressure region) and a low-pressure side (that is, intake pressure region). The high-pressure side is formed between the partition plate 216 and the top cover 212, and the low-pressure side is formed among the partition plate 216, the body 211 and the bottom cover 214. The inlet 218 configured to suck fluid is provided on the low-pressure side, and the outlet 219 configured to discharge the compressed fluid is provided on the high-pressure side. The outlet 219 is provided at the top center of the top cover 212 as shown in FIG. 3. However, those skilled in the art will understand that the outlet 219 may be provided at the side of the top cover 212 as shown in FIG. 2.

A motor 220 composed of a stator (not labeled) and a rotor (not labeled) is provided in the housing 210. A drive shaft 230 is provided in the rotor to drive a compression mechanism (not labeled) composed of a non-orbiting scroll component (not labeled) and an orbiting scroll component (not labeled).

Driven by the motor 220, the orbiting scroll component orbits relative to the non-orbiting scroll component (that is, a central axis of the orbiting scroll component rotates about a central axis of the non-orbiting scroll component, but the orbiting scroll component itself does not rotate about its own central axis) to achieve compression of the fluid. The fluid compressed by the non-orbiting scroll component and the orbiting scroll component is discharged to the high-pressure side.

During the operation of the compressor 200, the lubricant stored at the bottom of the housing 210 may be supplied to an end portion of an eccentric crank pin (not labeled) through an oil supply passage 233 formed in the drive shaft 230, and flow and splash under the action of gravity and centrifugal force to lubricate and cool other movable parts in the compressor.

Figure 4:
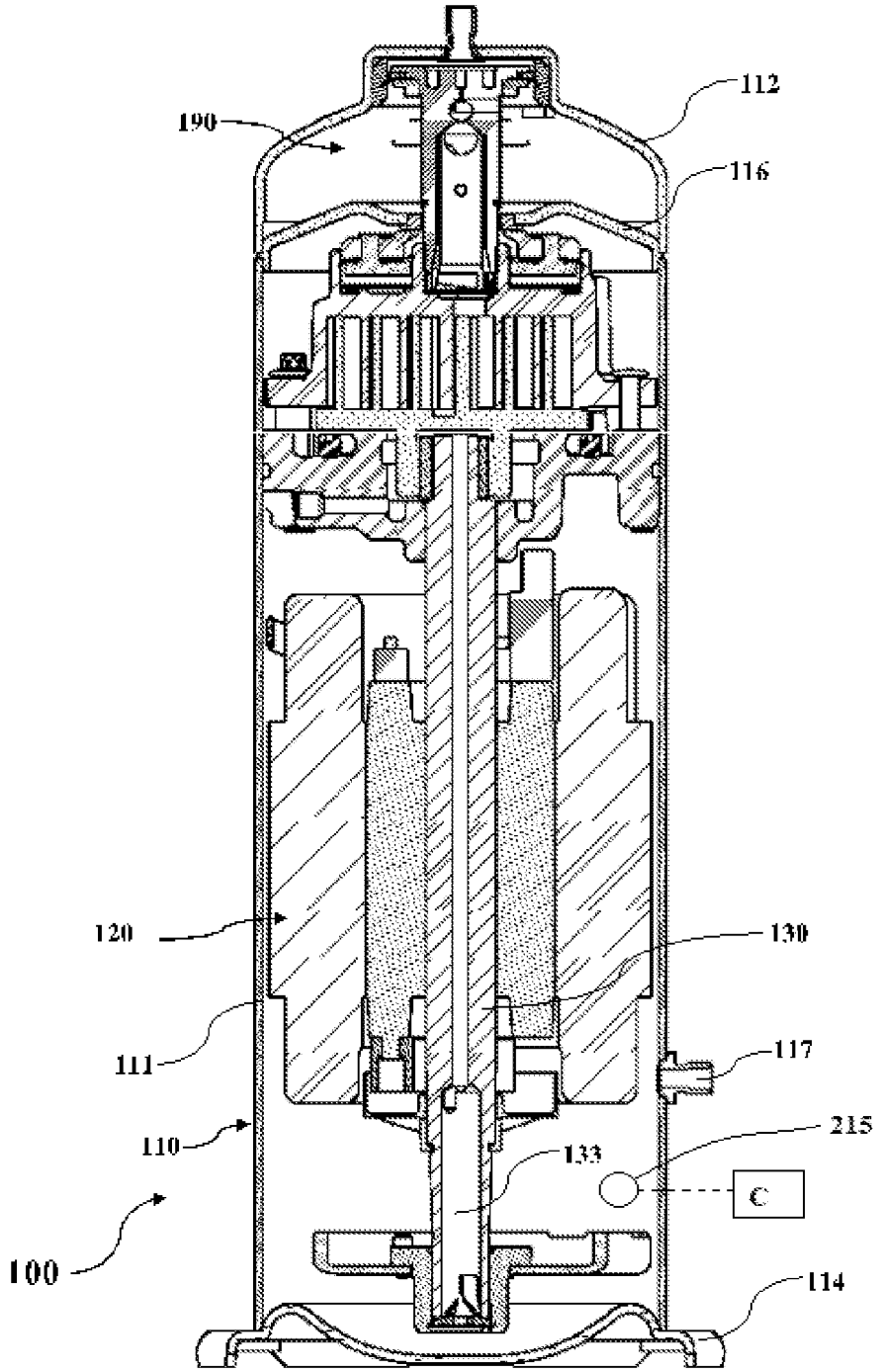
FIG. 4 is a schematic sectional view of another compressor in the compressor system according to an embodiment of this disclosure.

FIG. 4 shows a variable capacity scroll compressor. The first compressor 100 in FIG. 2 may adopt the configuration of the compressor shown in FIG. 4, but it is not limited thereto. The basic configuration of the scroll compressor 100 shown in FIG. 4 may be substantially the same as the scroll compressor 200 shown in FIG. 3. Briefly, the housing 110 of the scroll compressor 100 (the first housing 110 described above) includes a substantially cylindrical body 111, a top cover 112 and a bottom cover 114. A partition plate 116 is arranged between the top cover 112 and the body 111 to partition an internal space of the compressor into a high-pressure side (that is, discharge pressure region) and a low-pressure side (that is, intake pressure region). An inlet 118 (shown in FIG. 2, not shown in FIG. 4) configured to suck fluid is provided on the low-pressure side, and an outlet 119 (shown in FIG. 2, not shown in FIG. 4) configured to discharge the compressed fluid is provided on the high-pressure side. A motor 120 composed of a stator (not labeled) and a rotor is provided in the housing 110. A drive shaft 130 is provided in the rotor to drive a compression mechanism (not labeled) composed of a non-orbiting scroll component (not labeled) and an orbiting scroll component (not labeled). During the operation of the compressor 100, the lubricant stored at the bottom of the housing 110 may lubricate and cool other movable parts in the compressor.

The variable capacity scroll compressor 100 shown in FIG. 4 may further include a capacity adjustment mechanism 190 which is configured such that the non-orbiting scroll component and the orbiting scroll component are separated from each other or engaged with each other in an axial direction of the compressor 100 to perform loading operation and unloading operation. The compressor 100 can achieve capacity adjustment of the compressor by alternately performing the loading operation and the unloading operation. By controlling the loading operation and the unloading operation of the capacity adjustment mechanism 190, the compressor 100 can realize capacity adjustment from 0% to 100%. It should be understood by those skilled in the art that the capacity adjustment mechanism shown in FIG. 4 is only an example, and the variable capacity (scroll) compressor described in this application may adopt any type of capacity adjustment technology in the related art.

In the compressor system 10 composed of the above compressors 100 and 200, for example, when the compressors 100 and 200 have the same (maximum) capacity (both 100%), the entire compressor system 10 can provide capacity adjustment from 0% to 200%. It should be understood by those skilled in the art that other constant or variable capacity compressors may be further connected in parallel in the compressor system 10, so that the compressor system with the above configuration can be realized with more flexible capacity modulation, larger total capacity and lower cost.

As described above, the intake pipe 300 in the compressor system 10 may further include the lubricant separator 310 for separating lubricant from the fluid flowing through the intake pipe 300 to selectively supply the separated lubricant to the first compressor 100 or the second compressor 200.

The intake pipe 300 for the compressor system 10 according to the embodiments of the present application will be described in detail below with reference to FIGS. 5 and 6.

Figure 6:
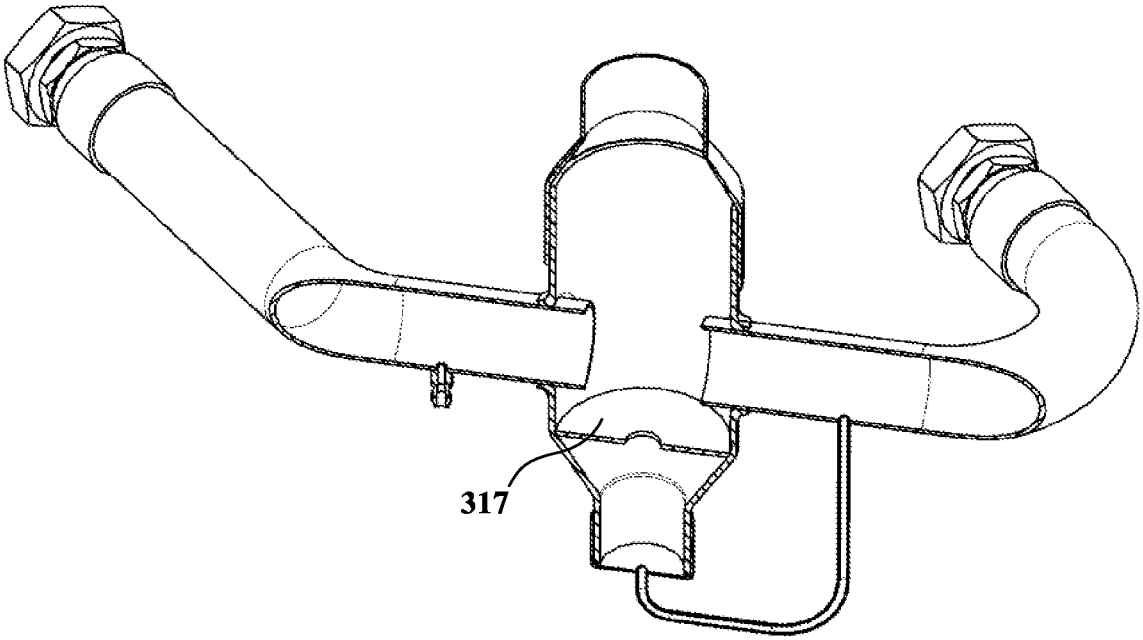
FIG. 6 is a schematic perspective view showing the partial section of the intake pipe shown in FIG. 5.

As shown in FIGS. 5 and 6, the intake pipe 300 may include a lubricant separator 310, a first lubricant supply pipe 340, a first intake branch pipe 320 and a second intake branch pipe 330. The first intake branch pipe 320 is configured to introduce the fluid to be compressed which flows into the lubricant separator into the first compressor 100, and the second intake branch pipe 330 is configured to introduce the fluid to be compressed which flows into the lubricant separator 310 into the second compressor 200. The lubricant separator 310 separates the lubricant from the fluid to be compressed which flows through the intake pipe 300 and temporarily preserves the lubricant therein. The first lubricant supply pipe 340 is in fluid communication with the lubricant separator 310, so that the separated lubricant is supplied into the compressor where the lubricant may be insufficient. In the embodiment shown in FIGS. 2A and 5, the lubricant is supplied to the first compressor 100. Alternatively, as shown in FIG. 2B, the lubricant is supplied to the second compressor 200 via second intake branch pipe 330. The lubricant shortage phenomenon may be caused from, but is not limited to, the following reasons: due to different operating conditions or systemic differences of the compressors, a pressure difference will be formed between the intake pressure regions of the compressors, and under this pressure difference, the lubricant accumulated at the bottom will flow to the compressor with lower pressure along the lubricant balance pipe 6, resulting in lubricant shortage in the compressor with higher pressure; on the other hand, especially in the case of variable frequency compressor or variable capacity compressor, the difference in intake and discharge volume between the compressors may also cause lubricant shortage in some compressors.

For this reason, in one embodiment of this disclosure, assuming that the first compressor 100 has a shortage of lubricant (for example, it can be determined in advance by means of experiments, numerical simulation, etc.), one end of the first lubricant supply pipe 340 can be connected to the lubricant separator 310 and the other end thereof can be connected to the first intake branch pipe 320 (FIG. 2A) to supply the separated lubricant to the first compressor 100 according to Bernoulli's principle, which will be described in detail below.

In a preferred embodiment, a part of the first intake branch pipe 320 (left end as shown in FIG. 5) and a part of the second intake branch pipe 330 (right end as shown in FIG. 5) extend into the interior of the lubricant separator 310 to prevent the lubricant climbing along an inner wall of the lubricant separator 310 from flowing back to the first intake branch pipe 320 and the second intake branch pipe 330.

In the embodiment shown in FIG. 5, the lubricant separator 310 is substantially cylindrical and includes a top opening 311, a side wall 312 and a bottom wall 313. The top opening 311 opens upward to allow the fluid to be compressed from the application equipment such as refrigeration equipment in the compressor system 10 to enter the lubricant separator 310. The side wall 312 is provided with a first side wall outlet 318 and a second side wall outlet 319. The first intake branch pipe 320 is inserted into the first side wall outlet 318, and the second intake branch pipe 330 is inserted into the second side wall outlet 319, so as to be in fluid communication with the lubricant separator 310. It is understood that, in other embodiments, the lubricant separator 310 may include other types of separators or be of any other suitable shape, such as a cyclone separator.

Due to the separation effect of the lubricant separator 310, the separated lubricant is collected on the bottom or the bottom wall 313 of the lubricant separator 310 under the action of gravity. The bottom wall 313 may be provided with a bottom wall opening 314 to communicate with one end of the first lubricant supply pipe 340 for outflow of the lubricant.

As shown in FIG. 5, the other end (right end as shown) of the first lubricant supply pipe 340 communicates with the first intake branch pipe 320 from a lower side. It should be understood by those skilled in the art that the fluid to be compressed passes fast through the other end of the first lubricant supply pipe 340, while the lubricant collected at the one end of the first lubricant supply pipe 340 flows slowly (or at a flow rate of about zero). Thus, according to Bernoulli's principle, the pressure at the one end of the first lubricant supply pipe 340 is higher than the pressure at the other end of the first lubricant supply pipe 340, and this pressure difference can feed the lubricant accumulated on the bottom or bottom wall 313 of the lubricant separator 310 to the first intake branch pipe 320.

Figure 8:
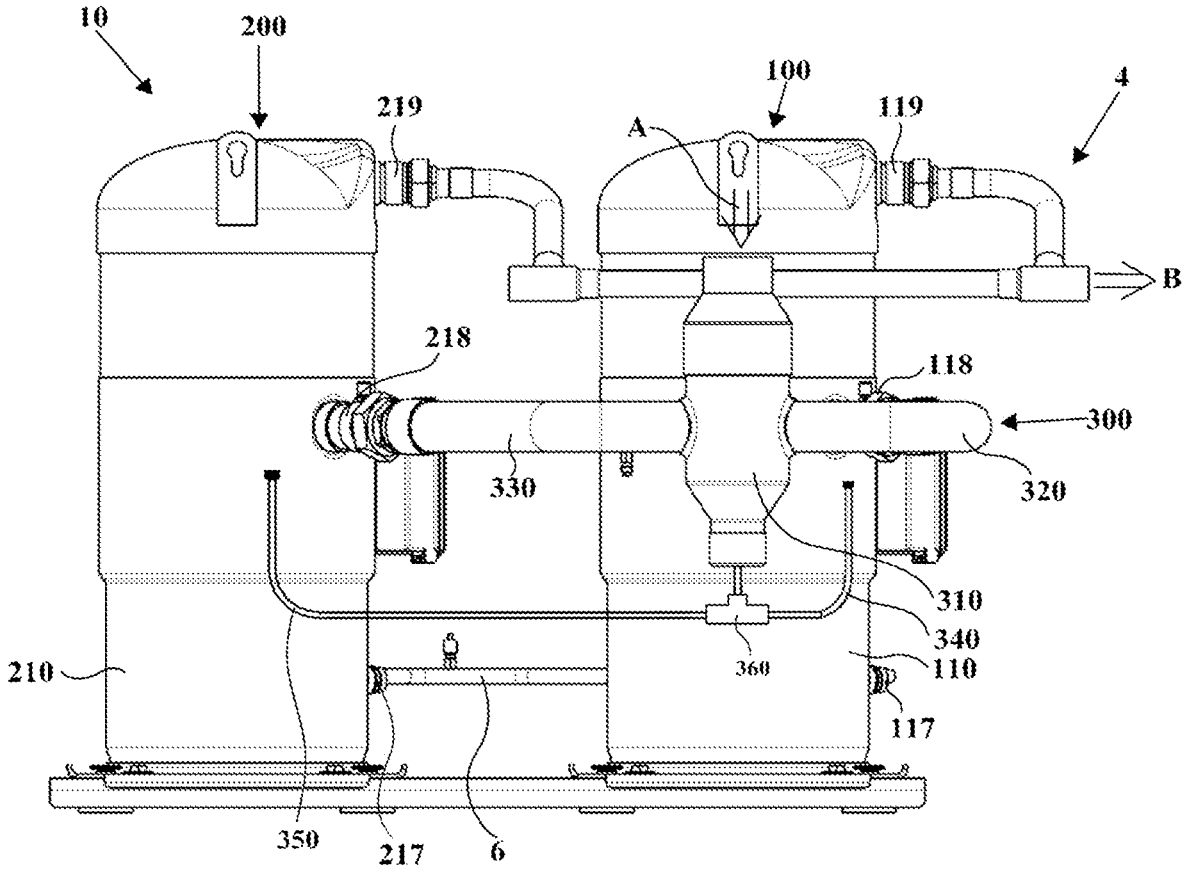
FIG. 8 is a schematic side view of a compressor system according to another embodiment of this disclosure.

In another embodiment of the present application (see, e.g., FIG. 8), the other end of the first lubricant supply pipe 340 may directly communicate with the first housing 110 of the first compressor 100, and the other end of the second lubricant supply pipe 350 may directly communicate with the second housing 210 of the second compressor 200. Due to the pressure drop in the first intake branch pipe 320 and/or the action of gravity, the lubricant on the bottom wall 313 of the lubricant separator 310 can also be transferred into the first compressor 100. It shall be noted that, in this embodiment, since the lubricant is not carried into the first compressor 100 by the fluid to be compressed, the content of lubricant in the fluid to be compressed which enters the first compressor 100 is relatively low. As a result, the compression mechanism can be prevented from being damaged due to excessive lubricant brought into the compression mechanism by the fluid to be compressed.

In the embodiment shown in FIG. 5, a partition plate 317 may be provided in the lubricant separator 310. The partition plate 317 extends substantially horizontally and separates the bottom or bottom wall 313 storing lubricant from the first intake branch pipe 320 and the second intake branch pipe 330. As shown in FIG. 6, the partition plate 317 is provided with an orifice (not labeled) allowing lubricant to flow therethrough. The partition plate 317 separates a flow path of the fluid to be compressed from the collection region of the separated lubricant, thereby preventing the fluid to be compressed which is flowing in the lubricant separator 310 from blowing the separated lubricant. On the one hand, the separated lubricant is prevented from being brought into the compressor by the fluid to be compressed. On the other hand, the fluid to be compressed which enters from the top opening 311 can impact the partition plate 317, thus facilitating the separation of the lubricant from the fluid to be compressed.

In general, the lubricant separator 310 may have a larger diameter or size than the diameter of the top opening 311 and that of the intake branch pipe to reduce the speed of the fluid to be compressed. In the illustrated embodiment, the side wall 312 includes an upper truncated conical structure 315 tapering toward the top opening 311 between the first and second side wall outlets 318, 319 and the top opening 311, and a lower truncated conical structure 316 tapering toward the bottom wall 313 between the first and second side wall outlet 318, 319 and the bottom wall 313. The upper truncated conical structure 315 can increase the volume of the lubricant separator 310, thereby reducing the flow rate of the fluid to be compressed which enters the lubricant separator 310, and facilitating the separation of the lubricant. The lower truncated conical structure 316 can facilitate the collection of the lubricant.

In a preferred embodiment, a valve (not shown) may be provided on the first lubricant supply pipe 340. In particular, the opening degree of the valve may be adjusted to allow selective and flow-adjustable supply of the lubricant to the first compressor 100. The valve may be in the form of a solenoid valve to perform on-off operations and opening-degree adjustment operations based on instructions from the control component in the compressor system 10.

As shown in FIG. 5, the second intake branch pipe 330 is provided with a joint 332 for communicating with the other end of the first lubricant supply pipe 340. As such, the separated lubricant can be selectively supplied to the first compressor 100 or the second compressor 200 (for example, by manual) according to actual operation conditions.

Figure 7:
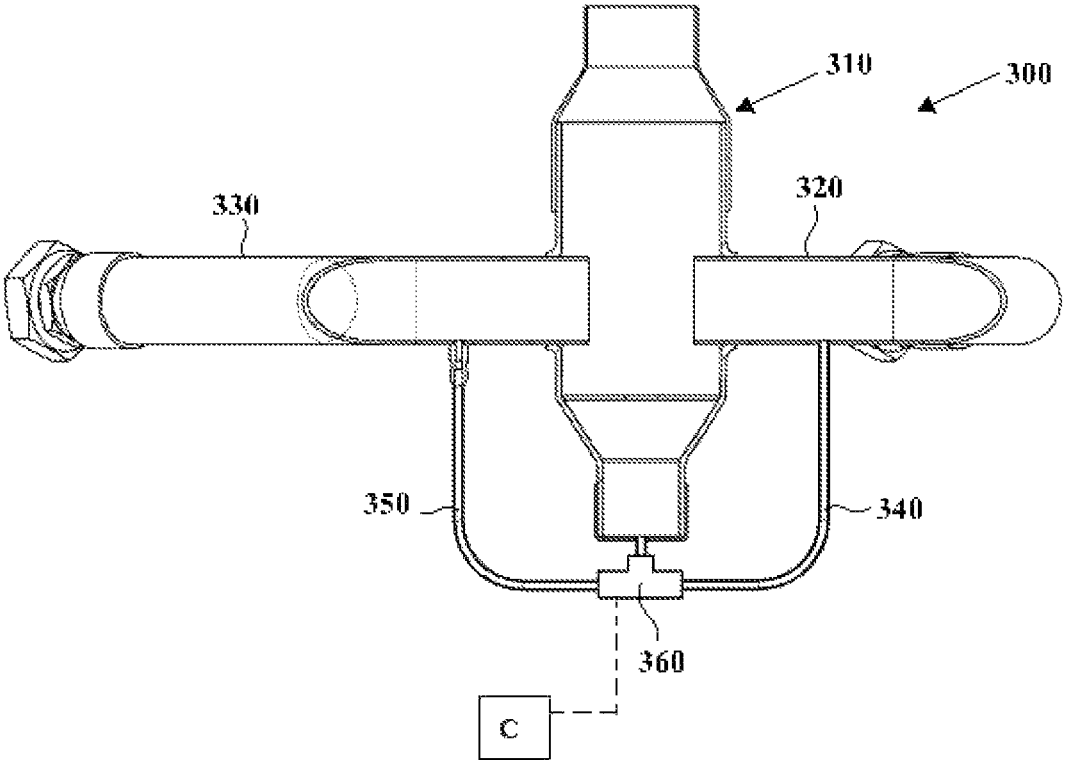
FIG. 7 is a schematic side view showing a partial section of the intake pipe according to another embodiment of this disclosure.

FIG. 7 shows an intake pipe 300 according to another embodiment of the present application. The intake pipe 300 differs from the intake pipe 300 shown in FIGS. 5 and 6 in further including a second lubricant supply pipe 350. The same or similar features are still denoted by the same reference numerals.

As shown in FIG. 7, the first lubricant supply pipe 340 and the second lubricant supply pipe 350 each communicate (directly or indirectly) with the bottom wall 313 at one end thereof, and respectively communicate with the first intake branch pipe 320 and the second intake branch pipe 330 at the other end thereof. In addition, the intake pipe 300 is further provided with a valve 360 to selectively supply the separated lubricant to the first compressor 100 through the first lubricant supply pipe 340 or to the second compressor 200 through the second lubricant supply pipe 350.

Specifically, the valve 360 may be in the form of a three-way valve, having a port communicating with the bottom wall 313 of the lubricant separator 310, and two ports respectively communicating with the first lubricant supply pipe 340 and the second lubricant supply pipe 350. The operation of the valve 360 may allow the lubricant to be supplied to the first compressor 100 only through the first lubricant supply pipe 340 or to the second compressor 200 only through the second lubricant supply pipe 350. In another embodiment, the operation of the valve 360 may allow the lubricant to be simultaneously supplied to the first compressor 100 through the first lubricant supply pipe 340 and to the second compressor 200 through the second lubricant supply pipe 350, and may adjust the ratio of the amount of lubricant supplied to the first compressor 100 through the first lubricant supply pipe 340 to the amount of lubricant supplied to the second compressor 200 through the second lubricant supply pipe 350.

In other embodiments of the present application, dedicated valves may be respectively provided for the first lubricant supply pipe 340 and the second lubricant supply pipe 350, and lubricant supply to the two compressors may be realized through the coordinated control of the two dedicated valves.

In the embodiment shown in FIG. 7, a control component C is further provided to control the operation of the valve 360. The control component may be a separate component or may be integrated into a control unit of the compressor or the compressor system. The control component obtains information on which compressor has insufficient lubricant, and controls the operation of the valve 360 to supply lubricant to the compressor that has insufficient lubricant based on the information.

The information on which compressor has insufficient lubricant may be loaded in the control unit of the compressor system 10 in advance. For example, in a case that the compressor system 10 includes a constant frequency compressor and a variable frequency compressor, the compressor system may be configured to supply lubricant to the variable frequency compressor when the rotational speed of the drive shaft of the variable frequency compressor is greater than a first predetermined value; and supply lubricant to the constant frequency compressor when the rotational speed of the drive shaft of the variable frequency compressor is less than a second predetermined value less than or equal to the first predetermined value. Therefore, the lubricant imbalance in the compressor system can be systemically improved before the product leaves the factory, and sensors may be omitted in the technical scheme.

In addition, in another embodiment of the present application, the information on which compressor has insufficient lubricant may come from a sensor 215 (FIG. 3) provided in the compressor 200 and a sensor 115 provided in compressor 100 (FIG. 2). For example, as described above, when the pressure in the intake pressure region of the first compressor is higher than the pressure in the intake pressure region of the second compressor, the lubricant at the bottom of the compressor will flow into the second compressor 200 through the lubricant balance pipe 6 under the action of the pressure difference. To this end, the sensors 115 and 215 may be a pressure sensor that may be provided in the compressors 100, 200 to sense the pressure difference, thereby obtaining or concluding the information on which compressor 100, 200 has insufficient lubricant.

In yet another embodiment of the present application, the sensor 115, 215 may include a liquid level sensor to obtain the information on which compressor 100, 200 has insufficient lubricant by directly measuring the amount of lubricant in the compressor 100, 200. In other embodiments, the sensor 115, 215 may further include at least one of, for example, a rotational speed sensor that measures the rotational speed of the drive shaft, a vibration sensor that measures the amplitude of the drive shaft, a torque sensor that measures the transmission torque of the drive shaft, a temperature sensor that measures the temperature of the intake pressure region, and a flow sensor that measures amount of the intake gas. Therefore, it can be determined which compressor 100 or 200 has insufficient lubricant based on at least one of the following conditions:

- whether the rotational speed of the drive shaft of the compressor 100, 200 is greater than or less than a predetermined rotational speed;
- whether the amplitude of the compressor 100, 200 is greater than a predetermined amplitude;
- whether the torque of the drive shaft of the compressor 100, 200 is greater than a predetermined torque;

whether the temperature of a particular member or region within the compressor 100, 200 is higher than a predetermined temperature; and whether quantity of the intake or discharged gas of the compressor 100, 200 is greater than or less than a predetermined quantity of flow.

Each of the above predetermined values may be set in advance according to the specific characteristics, operating conditions, etc. of the compressor and the compressor system.

In summary, with the intake pipe 300 described in present application, the lubricant can be separated from the fluid to be compressed before it flows into the compressor, and the separated lubricant can be supplied into the compressor which has insufficient lubricant in the compressor system, so as to alleviate or even eliminate the lubricant imbalance problem between the compressors in the compressor system.

It should be noted that the first compressor 100 and/or the second compressor 200 in the embodiments of the present application may include, but not be limited to, variable capacity compressors, variable frequency compressors, horizontal compressors, or high-pressure side compressors.

It should be noted that, in the intake pipe 300 shown in FIG. 5 according to the embodiment of the present application, the lubricant separator 310 supplies the separated lubricant to the first compressor 100 only through the first lubricant supply pipe 340. In particular, in the embodiments described above, the sensor 115 for measuring the amount of lubricant may be provided only in the first compressor 100, and the sensor 215 for measuring the amount of lubricant in the second compressor 200 may be omitted.

The valve described in the embodiments of the present application may be a solenoid valve or a manual valve, but is not limited thereto. For example, the valve may be controlled by the control unit C in the compressor system 10 to achieve a desired lubricant balance.

It is understood that, in the entire compressor system 10, the total amount of lubricant is substantially constant. The lubricant (at least a part thereof) contained in the intake gas of the compressors 100 and 200 is separated in the lubricant separator 310 and stored in the lubricant separator 310. Since the pressure in the lubricant separator 310 and the lubricant storage region of the housing of the compressor 100 is the intake pressure, the lubricant in the lubricant separator 310 can flow into the first compressor 100 under the action of the pressure difference described above (caused from the effect of Bernoulli principle or the pressure drop of the intake branch pipe) without the need for any decompression components.

The compressor system 10 with the above configuration has the following advantages and modifications.

The lubricant supply and/or balance between the compressors can be realized by providing only one sensor 115 or 215 and one valve 360 in the compressor system, thus reducing the cost of the whole system and simplifying the control logic of the system. In other embodiments, for example, in the case that the compressor system 10 includes only two constant frequency compressors, only the first lubricant supply pipe 340 may be provided, and the second lubricant supply pipe 350, the sensor 215, and the valve 360 may be omitted.

In addition, in the embodiments described in this application, the compressor system 10 includes two compressors 100 and 200, but those skilled in the art will understand that the compressor system 10 may include three or more compressors to achieve more total capacity.

In addition, in the above embodiments, the first compressor 100 and the second compressor 200 are scroll compressors, but those skilled in the art will understand that these compressors may be selected from the groups consisting of piston compressors, rotor compressors, screw compressors, centrifugal compressors, and the like. In addition, the first compressor 100 and the second compressor 200 may be the same type of compressors or different types of compressors to realize a more flexible system arrangement.

It should be noted that the orientation terms such as "front", "back", "left", "right", "up", and "down" herein are for the purpose of description only, and should not be construed as limiting the direction and orientation of the embodiments of the present application in practical application.

Although the various embodiments of the present application have been described in detail herein, it is understood that the present application is not limited to the specific embodiments described and illustrated herein in detail. Other variations and modifications can be made by those skilled in the art without departing from the essence and scope of the present application. All such variations and modifications are within the scope of the present application.

Reference numerals for some features are listed as follows:

C control unit
1 compressor system in the related art
3 intake pipe in the related art
4 discharge pipe
6 lubricant balance pipe
10 compressor system according to the present application
100 first compressor
110 first housing
115 sensor
117 lubricant balance port
118 first inlet
119 first outlet
200 second compressor
210 second housing
215 sensor
217 lubricant balance port
218 second inlet
219 second outlet
300 intake pipe according to the present application
310 lubricant separator
311 top opening
312 side wall
313 bottom wall
314 bottom wall opening
315 truncated conical structure
316 truncated conical structure
317 partition plate
318 first sidewall outlet
319 second side wall outlet
320 first intake branch pipe
330 second intake branch pipe
332 joint
340 first lubricant supply pipe
350 second lubricant supply pipe
360 valve.

The invention claimed is:

1. An intake pipe for a compressor system, comprising:

a lubricant separator configured to separate lubricant from fluid to be compressed which is flowing through the intake pipe;

a first lubricant supply pipe attached to the lubricant separator and configured to supply the separated lubricant inside the lubricant separator to a first compressor or a second compressor in the compressor system;

a first intake branch pipe connected to a first inlet of a first housing of the first compressor; and a second intake branch pipe connected to a second inlet of a second housing of the second compressor, wherein the first intake branch pipe and the second intake branch pipe are connected to the lubricant separator, wherein the first intake branch pipe and the second intake branch pipe are configured to directly introduce the fluid to be compressed which is separated from the lubricant within the lubricant separator to the first compressor and the second compressor in the compressor system, respectively, wherein a portion of the first intake branch pipe and a portion of the second intake branch pipe both extend into the interior of the lubricant separator, and wherein the lubricant separator comprises a top opening, a side wall and a bottom wall, and wherein the top opening is adapted to allow the fluid to be compressed to enter the lubricant separator, the side wall is provided with a first side wall outlet through which the first intake branch pipe extends and a second side wall outlet through which the second intake branch pipe extends.

2. The intake pipe according to claim 1, further comprising a valve provided on the first lubricant supply pipe to supply the separated lubricant to the first compressor or the second compressor.

3. The intake pipe according to claim 1, further comprising a second lubricant supply pipe, wherein the first lubricant supply pipe is configured to supply the separated lubricant to the first compressor, and the second lubricant supply pipe is configured to supply the separated lubricant to the second compressor, and wherein the intake pipe further comprises a valve configured to selectively supply the separated lubricant to the first compressor through the first lubricant supply pipe or to the second compressor through the second lubricant supply pipe.

4. An intake pipe for a compressor system, comprising:

a lubricant separator configured to separate lubricant from fluid to be compressed which is flowing through the intake pipe;

a first lubricant supply pipe attached to the lubricant separator and configured to supply the separated lubricant inside the lubricant separator to a first compressor or a second compressor in the compressor system;

a first intake branch pipe connected to a first inlet of a first housing of the first compressor; and a second intake branch pipe connected to a second inlet of a second housing of the second compressor, wherein the first intake branch pipe and the second intake branch pipe are connected to the lubricant separator, wherein the first intake branch pipe and the second intake branch pipe are configured to directly introduce the fluid to be compressed which is separated from the lubricant within the lubricant separator to the first compressor and the second compressor in the compressor system, respectively, and wherein the lubricant separator comprises a top opening, a side wall and a bottom wall, and wherein the top opening is adapted to allow the fluid to be compressed to enter the lubricant separator, the side wall is provided with a first side wall outlet through which the first intake branch pipe extends and a second side wall outlet through which the second intake branch pipe extends, and the bottom wall is provided with a bottom wall opening communicating with one end of the first lubricant supply pipe.

5. The intake pipe according to claim 4, wherein another end of the first lubricant supply pipe is fixedly attached to the first intake branch pipe or the second intake branch pipe.

6. The intake pipe according to claim 4, wherein another end of the first lubricant supply pipe is fixedly attached to the first housing of the first compressor or the second housing of the second compressor.

7. The intake pipe according to claim 4, wherein a partition plate is provided between the first and second side wall outlets and the bottom wall, and the partition plate is provided with an orifice allowing lubricant to flow therethrough.

8. The intake pipe according to claim 4, wherein the side wall comprises:

an upper truncated conical structure tapering toward the top opening and arranged between the first and second side wall outlets and the top opening; and/or a lower truncated conical structure tapering toward the bottom wall and arranged between the first and second side wall outlets and the bottom wall.

9. The intake pipe according to claim 4, further comprising a valve provided on the first lubricant supply pipe to supply the separated lubricant to the first compressor or the second compressor.

10. The intake pipe according to claim 4, further comprising a second lubricant supply pipe, wherein the first lubricant supply pipe is configured to supply the separated lubricant to the first compressor, and the second lubricant supply pipe is configured to supply the separated lubricant to the second compressor, and wherein the intake pipe further comprises a valve configured to selectively supply the separated lubricant to the first compressor through the first lubricant supply pipe or to the second compressor through the second lubricant supply pipe.

11. A compressor system, comprising:

a first compressor, which comprises a first housing, and a first inlet and a first outlet provided in the first housing;

a second compressor, which comprises a second housing, and a second inlet and a second outlet provided in the second housing; and an intake pipe comprising:

a lubricant separator configured to separate lubricant from fluid to be compressed which is flowing through the intake pipe; and a first lubricant supply pipe attached to the lubricant separator and configured to supply the separated lubricant inside the lubricant separator to the first compressor or the second compressor, wherein the first inlet and the second inlet communicate with each other through the intake pipe for being supplied with fluid to be compressed;

a first intake branch pipe connected to the first inlet of the first housing of the first compressor; and a second intake branch pipe connected to the second inlet of the second housing of the second compressor, wherein the first intake branch pipe and the second intake branch pipe are connected to the lubricant separator, wherein the first intake branch pipe and the second intake branch pipe are configured to directly introduce the fluid to be compressed which is separated from the lubricant within the lubricant separator to the first compressor and the second compressor in the compressor system, respectively, and wherein the lubricant separator comprises a top opening, a side wall and a bottom wall, and wherein the top opening is adapted to allow the fluid to be compressed to enter the lubricant separator, the side wall is provided with a first side wall outlet through which the first intake branch pipe extends and a second side wall outlet through which the second intake branch pipe extends, and the bottom wall is provided with a bottom wall opening communicating with one end of the first lubricant supply pipe.

12. The compressor system according to claim 11, wherein a sensor is provided in at least one of the first compressor and the second compressor to obtain sensing information as to whether lubricant accumulated in the corresponding compressor is insufficient.

13. The compressor system according to claim 12, further comprising a control component, wherein the control component is configured to determine whether lubricant accumulated in the first compressor or the second compressor is insufficient based on the sensing information of the sensor, and control operation of a valve of the intake pipe to supply the separated lubricant to one of the first compressor and the second compressor in which the lubricant is insufficient.

14. The compressor system according to claim 12, wherein the sensor comprises at least one of a pressure sensor, a liquid level sensor, a rotational speed sensor, a vibration sensor, a torque sensor, a temperature sensor, and a flow sensor.

15. The compressor system according to claim 11, further comprising a control component, wherein the control component is configured to determine whether lubricant accumulated in the first compressor or the second compressor is insufficient based on a rotational speed of a drive shaft of the first compressor and/or the second compressor, and control operation of a valve of the intake pipe to supply the separated lubricant to one of the first compressor and the second compressor in which the lubricant is insufficient.

16. The compressor system according to claim 11, wherein the first compressor and/or the second compressor comprise a variable capacity compressor or a variable frequency compressor.

17. A compressor system, comprising:

a first compressor, which comprises a first housing, and a first inlet and a first outlet provided in the first housing;

a second compressor, which comprises a second housing, and a second inlet and a second outlet provided in the second housing; and an intake pipe comprising:

a lubricant separator configured to separate lubricant from fluid to be compressed which is flowing through the intake pipe; and a first lubricant supply pipe attached to the lubricant separator and configured to supply the separated lubricant inside the lubricant separator to the first compressor or the second compressor, wherein the first inlet and the second inlet communicate with each other through the intake pipe for being supplied with fluid to be compressed;

a first intake branch pipe connected to the first inlet of the first housing of the first compressor; and a second intake branch pipe connected to the second inlet of the second housing of the second compressor, wherein the first intake branch pipe and the second intake branch pipe are connected to the lubricant separator, wherein the first intake branch pipe and the second intake branch pipe are configured to directly introduce the fluid to be compressed which is separated from the lubricant within the lubricant separator to the first compressor and the second compressor in the compressor system, respectively, wherein a portion of the first intake branch pipe and a portion of the second intake branch pipe both extend into the interior of the lubricant separator, and wherein the lubricant separator comprises a top opening, a side wall and a bottom wall, and wherein the top opening is adapted to allow the fluid to be compressed to enter the lubricant separator, the side wall is provided with a first side wall outlet through which the first intake branch pipe extends and a second side wall outlet through which the second intake branch pipe extends.

18. The compressor system according to claim 17, wherein the bottom wall is provided with a bottom wall opening communicating with one end of the first lubricant supply pipe.

19. The compressor system according to claim 18, wherein another end of the first lubricant supply pipe is fixedly attached to the first intake branch pipe or the second intake branch pipe, or the another end of the first lubricant supply pipe is fixedly attached to the first housing of the first compressor or the second housing of the second compressor.

20. The compressor system according to claim 18, further comprising:

a sensor is provided in at least one of the first compressor and the second compressor to obtain sensing information as to whether lubricant accumulated in the corresponding compressor is insufficient; and a control component, wherein the control component is configured to determine whether lubricant accumulated in the first compressor or the second compressor is insufficient based on the sensing information of the sensor, and control operation of a valve of the intake pipe to supply the separated lubricant to one of the first compressor and the second compressor in which the lubricant is insufficient.

* * * * *